US011141757B1

(12) United States Patent
Lee

(10) Patent No.: US 11,141,757 B1
(45) Date of Patent: Oct. 12, 2021

(54) FITTING TUBE STRUCTURE OF GLUE GUN

(71) Applicant: HOMEEASE INDUSTRIAL CO., LTD., Shueishang Township, Chiayi County (TW)

(72) Inventor: Grace Lee, Shueishang Township (TW)

(73) Assignee: HOMEEASE INDUSTRIAL CO., LTD., Shueishang Township (TW)

( * ) Notice: Subject to any disclaimer, the term of this patent is extended or adjusted under 35 U.S.C. 154(b) by 0 days.

(21) Appl. No.: 17/111,680

(22) Filed: Dec. 4, 2020

(51) Int. Cl.
*B05C 17/005* (2006.01)

(52) U.S. Cl.
CPC .... *B05C 17/00546* (2013.01); *B05C 17/0052* (2013.01); *B05C 17/00526* (2013.01)

(58) Field of Classification Search
CPC ..... B05C 17/00546; B05C 17/0052; B05C 17/0053; B05C 17/00526; B05C 17/0055; B05C 17/00536; B29B 13/022
USPC ..... 222/146.2, 146.5; 219/230
See application file for complete search history.

(56) References Cited

U.S. PATENT DOCUMENTS 3,743,142 A * 7/1973 Elliott ..... B29C 66/861 222/146.5
3,744,921 A * 7/1973 Weller ..... B05C 17/00533 401/2
4,358,030 A * 11/1982 Leibhard ..... B05C 17/00526 222/146.2
4,561,569 A * 12/1985 Dziki ..... B05C 17/00523 219/230
4,664,296 A * 5/1987 Dziki ..... B05C 17/00533 219/230
4,706,852 A * 11/1987 Borst ..... B05C 17/0053 222/146.2
4,781,482 A * 11/1988 Ursprung ..... B05C 17/0053 219/229
4,804,110 A * 2/1989 Sperry ..... B05C 17/00536 222/56
5,026,188 A * 6/1991 Capodieci ..... B05C 17/0053 219/230
5,048,722 A * 9/1991 Lichu ..... B05C 17/0053 222/80
5,462,206 A * 10/1995 Kwasie ..... B05C 17/0053 222/146.5
5,553,758 A * 9/1996 Melendy ..... B05C 5/02 222/533
6,457,889 B1 * 10/2002 Lin ..... B05C 17/0053 126/401

(Continued)

*Primary Examiner* — Charles P. Cheyney
(74) *Attorney, Agent, or Firm* — Karin L. Williams; Alan D. Kamrath; Mayer & Williams PC

(57) ABSTRACT

A fitting tube structure of a glue gun contains: a conical connection part, an accommodation chamber, a feeding segment, and an open segment. The fitting assembly includes a first fixing tube, an O ring, a second fixing tube, a stop sleeve, a locating ring, and a coupling tube. The first fixing tube has a stepped portion. The O ring is retained between the stepped portion and the second fixing tube. The stop sleeve is fitted on the first fixing tube and has a large-diameter extension and a small-diameter extension, and the large-diameter extension covers the first fixing tube and is fitted on the large-diameter extension by using the locating ring. The coupling tube is fixed on the small-diameter extension. Furthermore, the first fixing tube, the second fixing tube, and the stop sleeve are fitted and are fixed by the locating ring and the coupling tube.

4 Claims, 6 Drawing Sheets

(56) References Cited

U.S. PATENT DOCUMENTS

2006/0191957 A1* 8/2006 Axinte ..... B05C 17/00526
222/146.5
2007/0114241 A1* 5/2007 Lin ..... B05C 17/00546
222/113

* cited by examiner

Cross sectional view of the line A-A of FIG.2.

FITTING TUBE STRUCTURE OF GLUE GUN

FIELD OF THE INVENTION

The present invention relates to a fitting tube structure of a glue gun which is capable of avoiding a leakage of glue and a rupture of the fitting assembly because of thermal expansion and contraction.

BACKGROUND OF THE INVENTION

Referring to FIG. 1, a conventional glue gun contains a conical connection part 10, an accommodation chamber 20 formed in a bottom of the conical connection part 10 and configured to accommodate a heater 30, a feeding segment 11 formed on a front end of the conical connection part 10, and an open segment 12 defined on a rear end of the conical connection part 10 and configured to connect with a fitting assembly 40A. In use, a glue supply bar P is inserted into the fitting assembly 40A from the open segment 12, and the heater 30 melts the glue bar into adhesive glue, then the adhesive glue is extruded out of the feeding segment 11.

However, after the heater 30 heats the glue bar in a temperature of 200° C., the fitting assembly 40A is soften to cause a leakage of the adhesive glue. In addition, the fitting assembly 40A deforms or ruptures in the temperature of 200° C.

As shown in FIGS. 2 and 3, an improved fitting assembly 40B is provided and contains a first connection sleeve 40B1 and a second connection sleeve 40 B2 which are stacked and fixed on the open segment 12. However, a gap D produces between the first connection sleeve 40Ba and the second connection sleeve 40B2. In use of the improved fitting assembly 40B, the heater 30 heats the first connection sleeve 40B1 so that the first connection sleeve 40B1 expands, and the first connection sleeve 40B1 retracts after cooling down, thus enlarging the gap between the first connection sleeve 40B1 and the second connection sleeve 40B2 and leaking the adhesive glue out of the gap.

The present invention has arisen to mitigate and/or obviate the afore-described disadvantages.

SUMMARY OF THE INVENTION

The primary aspect of the present invention is to provide a fitting tube structure of a glue gun which contains the first fixing tube, the second fixing tube, and the stop sleeve fitted together and fixed by the locating ring and the coupling tube so as to avoid a deformation of the first fixing tube because of thermal expansion and contraction, thus enhancing a service life of the first fixing tube.

To obtain above-mentioned aspects, a fitting tube structure of a glue gun provided by the present invention contains: a conical connection part, an accommodation chamber formed in a bottom of the conical connection part and configured to accommodate a heater, a feeding segment formed on a front end of the conical connection part, and an open segment defined on a rear end of the conical connection part and configured to connect with a fitting assembly.

The fitting assembly includes a first fixing tube, an O ring, a second fixing tube made of aluminum or aluminum alloy, a stop sleeve, a locating ring, and a coupling tube.

A first end of the first fixing tube is connected with the open segment of the conical connection part, and a second end of the first fixing tube is coupled with the second fixing tube, wherein the first fixing tube has a stepped portion formed on a center thereof.

The O ring is retained between the stepped portion of the second fixing tube and the second fixing tube.

The stop sleeve is fitted on an outer wall of the first fixing tube and has a large-diameter extension and a small-diameter extension, and the large-diameter extension covers the first fixing tube, and the locating ring is fitted on an outer wall of the large-diameter extension.

The coupling tube is fixed on an outer wall of the small-diameter extension.

The first fixing tube, the second fixing tube, and the stop sleeve are fitted and are fixed by the locating ring and the coupling tube.

Preferably, the resilient retainer is mounted between the first fixing tube and the open segment.

Preferably, the small-diameter extension of the stop sleeve has multiple defining ribs formed thereon so as to increase a contact area of the stop sleeve and the coupling tube.

Preferably, the first fixing tube and the coupling tube are made of hard plastic.

DETAILED DESCRIPTION OF THE PREFERRED EMBODIMENTS

Figure 1:
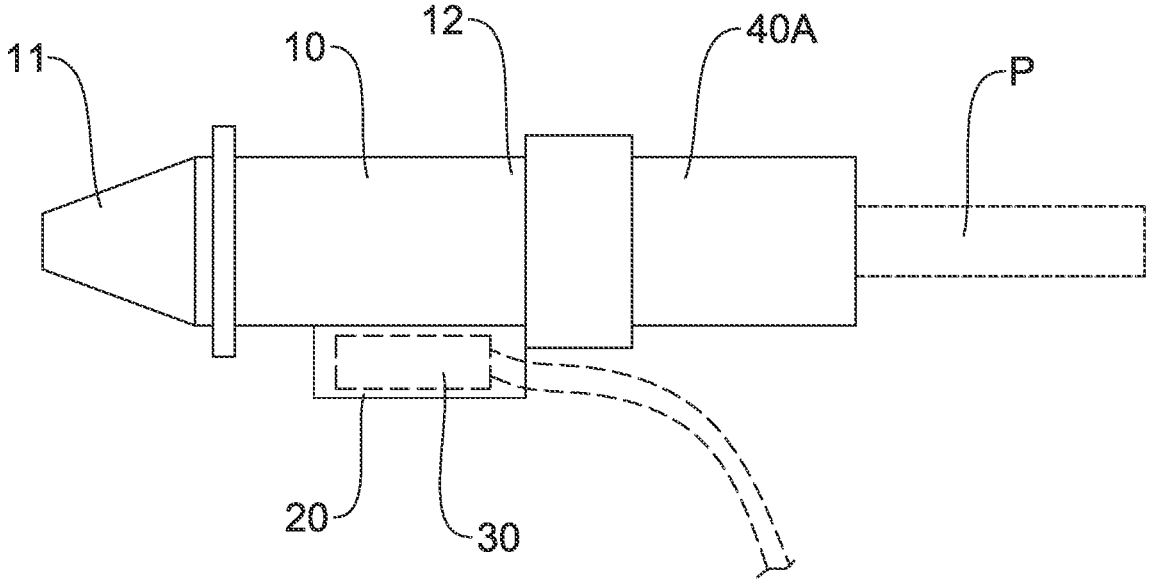
PRIOR ART FIG.1
FIG. 1 is a side plan view of a conventional fitting tube structure of a glue gun.
Figure 2:
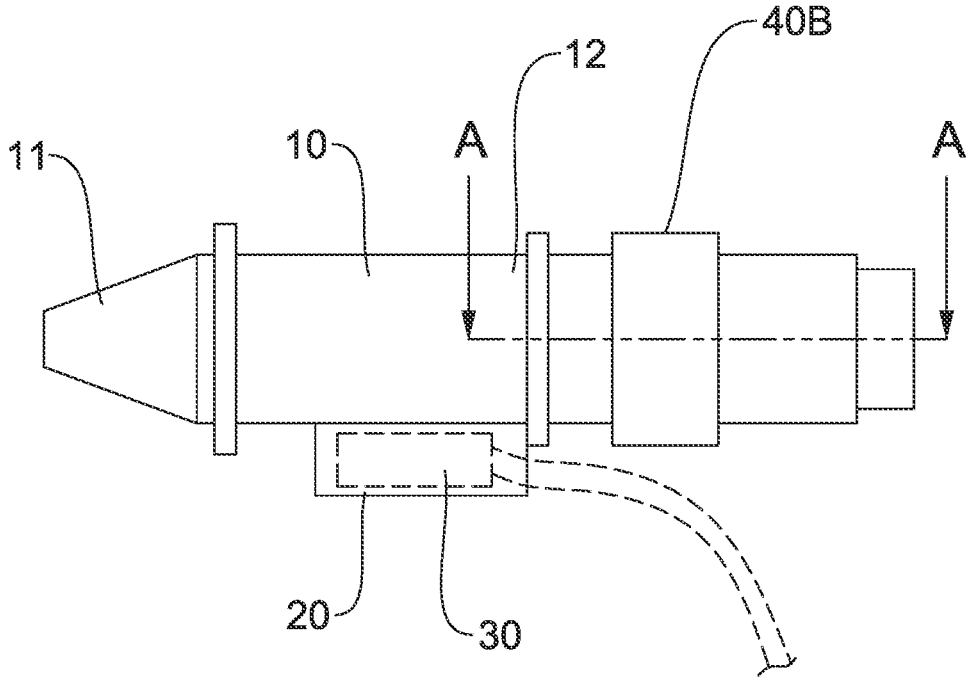
PRIOR ART FIG.2
FIG. 2 is a side plan view of a conventional fitting tube structure of another glue gun.
Figure 3:
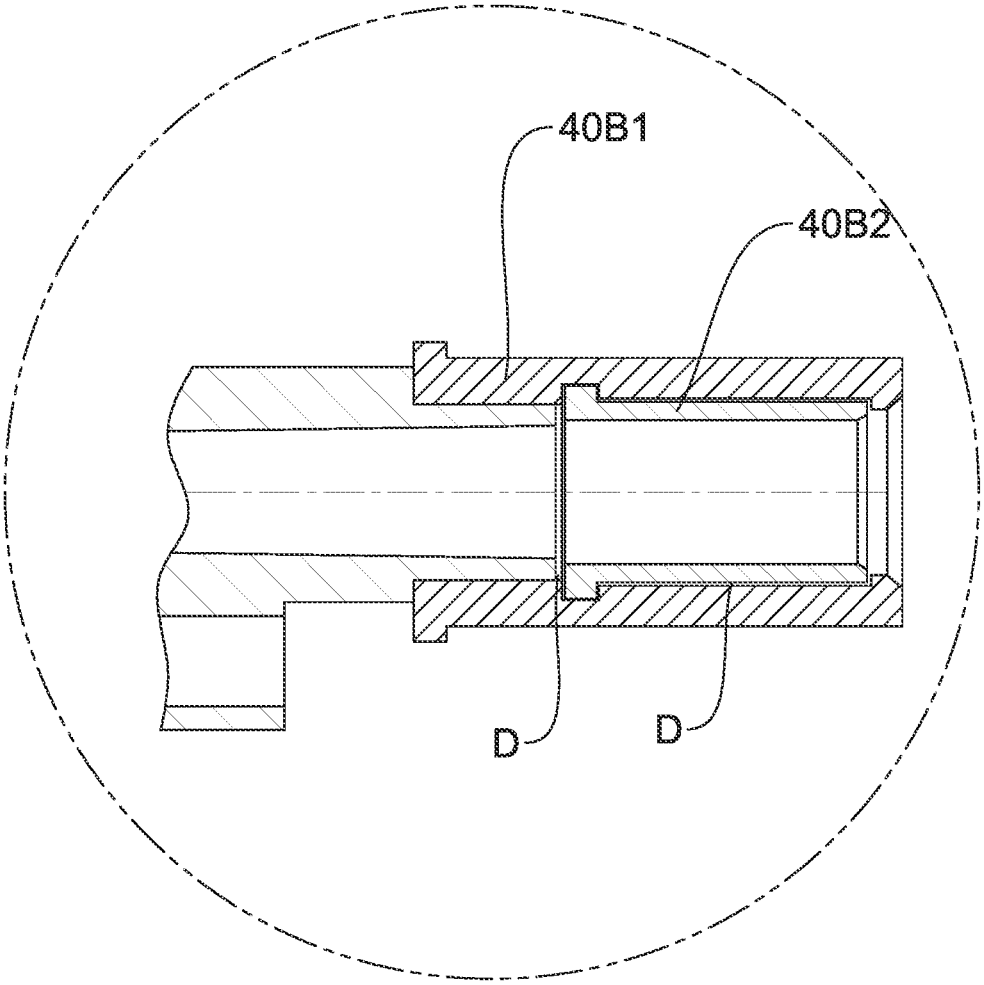
PRIOR ART FIG.3
FIG. 3 is a cross sectional view taken along the line A-A of FIG. 2.
Figure 4:
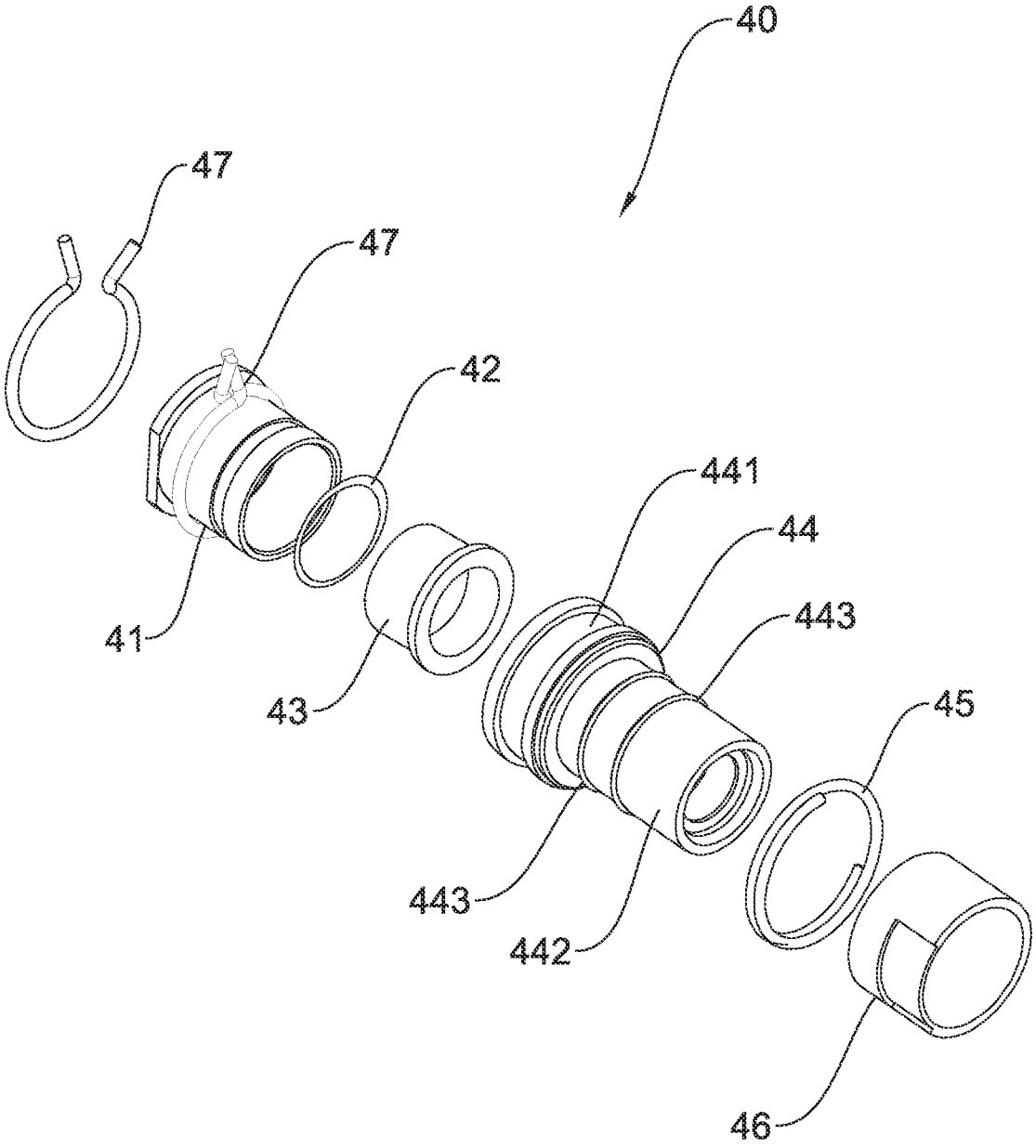
FIG. 4 is a perspective view showing the exploded components of a fitting tube structure of a glue gun according to a preferred embodiment of the present invention.
Figure 5:
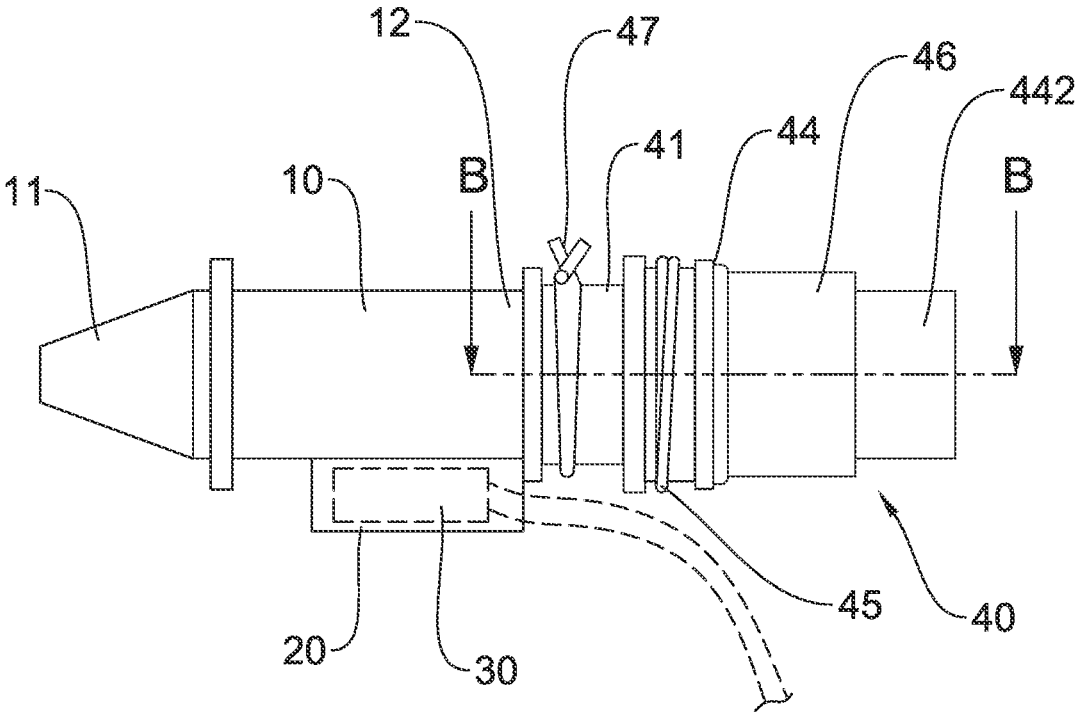
FIG. 5 is a side plan view showing the assembly of the fitting tube structure of the glue gun according to the preferred embodiment of the present invention.
Figure 6:
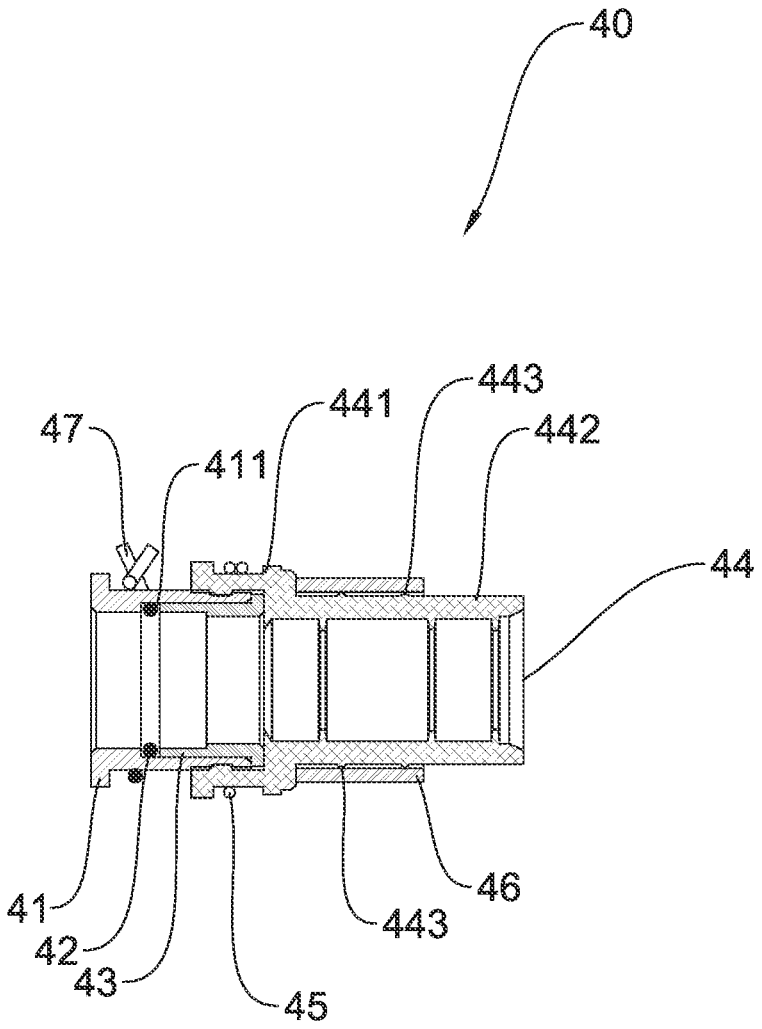
FIG. 6 is a cross sectional view showing the assembly of the fitting tube structure of the glue gun according to the preferred embodiment of the present invention.

With reference to FIGS. 4-6, a fitting tube structure of a glue gun according to a preferred embodiment of the present invention comprises: a conical connection part 10 configured to receive a melted glue bar, an accommodation chamber 20 formed in a bottom of the conical connection part 10 and configured to accommodate a heater 30, a feeding segment 11 formed on a front end of the conical connection part 10, and an open segment 12 defined on a rear end of the conical connection part 10 and configured to connect with a fitting assembly 40.

Referring to FIGS. 4-6, the fitting assembly 40 includes a first fixing tube 41, an O ring 42, a second fixing tube 43 made of aluminum or aluminum alloy, a stop sleeve 44, a locating ring 45, a coupling tube 46, and a resilient retainer 47.

As shown in FIGS. 4-6, the first fixing tube 41 is made of hard plastic and has a heat dissipation, a first end of the first fixing tube 41 is connected with the open segment 12 of the conical connection part 10, and a second end of the first fixing tube 41 is coupled with the second fixing tube 43, wherein the first fixing tube 41 has a stepped portion 411 formed on a center thereof; the O ring 42 is retained between the stepped portion 411 of the second fixing tube 43 and the second fixing tube 43, wherein a heat resistance of the second fixing tube 43 is higher than a heat resistance of the plastic of the first fixing tube 41 so as to avoid a deformation of the fitting assembly 40 because of thermal expansion and contraction, thus enhancing a service life of the first fixing tube 41. Furthermore, the resilient retainer 47 is mounted between the first fixing tube 41 and the open segment 12.

As illustrated in FIGS. 4-6, the stop sleeve 44 is fitted on an outer wall of the first fixing tube 41 and has a large-diameter extension 441 and a small-diameter extension 442, wherein the large-diameter extension 441 covers the first fixing tube 41, and the locating ring 45 is fitted on an outer wall of the large-diameter extension 441; the coupling tube 46 is fixed on an outer wall of the small-diameter extension 442 and is made of hard plastic so as to fasten the small-diameter extension 442 of the stop sleeve 44, thus avoiding deformation of the stop sleeve 44.

The first fixing tube 41, the second fixing tube 43, and the stop sleeve 44 are fitted and are fixed by the locating ring 45 and the coupling tube 46 so as to avoid a leakage of glue and a rupture of the fitting assembly 40. The small-diameter extension 442 of the stop sleeve 44 has multiple defining ribs 443 formed thereon so as to increase a contact area of the stop sleeve 44 and the coupling tube 46, thus connecting the stop sleeve 44 and the coupling tube 46 securely.

With reference to FIGS. 4-6, in use, the fitting assembly 40 is connected on the open segment 12 of the conical connection part 10. Preferably, the fitting assembly 40 includes the first fixing tube, the O ring, the second fixing tube, the stop sleeve, the locating ring, the coupling tube and the resilient retainer, the first fixing tube and the coupling tube have the heat resistance, and the second fixing tube is made of the aluminum alloy so as to avoid the deformation and the rupture of the fitting assembly because of thermal expansion and contraction.

While the preferred embodiments of the invention have been set forth for purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A fitting tube structure of a glue gun comprising:

a conical connection part, an accommodation chamber formed in a bottom of the conical connection part and configured to accommodate a heater, a feeding segment formed on a front end of the conical connection part, and an open segment defined on a rear end of the conical connection part and configured to connect with a fitting assembly;

wherein the fitting assembly includes a first fixing tube, an O ring, a second fixing tube made of aluminum or aluminum alloy, a stop sleeve, a locating ring, and a coupling tube;

wherein a first end of the first fixing tube is connected with the open segment of the conical connection part, and a second end of the first fixing tube is coupled with the second fixing tube, wherein the first fixing tube has a stepped portion formed on a center thereof;

wherein the O ring is retained between the stepped portion of the second fixing tube and the second fixing tube;

wherein the stop sleeve is fitted on an outer wall of the first fixing tube and has a large-diameter extension and a small-diameter extension, and the large-diameter extension covers the first fixing tube, and the locating ring is fitted on an outer wall of the large-diameter extension;

wherein the coupling tube is fixed on an outer wall of the small-diameter extension; and wherein the first fixing tube, the second fixing tube, and the stop sleeve are fitted and are fixed by the locating ring and the coupling tube.

2. The fitting tube structure of the glue gun as claimed in claim 1, wherein a resilient retainer is mounted between the first fixing tube and the open segment.

3. The fitting tube structure of the glue gun as claimed in claim 1, wherein the small-diameter extension of the stop sleeve has multiple defining ribs formed thereon so as to increase a contact area of the stop sleeve and the coupling tube.

4. The fitting tube structure of the glue gun as claimed in claim 1, wherein the first fixing tube and the coupling tube are made of hard plastic.

* * * * *